US012215859B2

(12) United States Patent
Guardigli et al.

(10) Patent No.: US 12,215,859 B2
(45) Date of Patent: Feb. 4, 2025

(54) GAS CAVITY BURNER

(71) Applicant: ELECTROLUX APPLIANCES AKTIEBOLAG, Stockholm (SE)

(72) Inventors: Nicola Guardigli, Forli (IT); Ferdinando Vivacqua, Forli (IT); Areli Uribe Portugal, Forli (IT); Pierpaolo Fabiani, Forli (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 345 days.

(21) Appl. No.: 17/577,660

(22) Filed: Jan. 18, 2022

(65) Prior Publication Data

US 2023/0087485 A1 Mar. 23, 2023

(30) Foreign Application Priority Data

Sep. 22, 2021 (BR) ..... 1020210189347

(51) Int. Cl.
*F23D 14/58* (2006.01)
*F24C 3/08* (2006.01)

(52) U.S. Cl.
CPC ..... *F23D 14/583* (2013.01); *F24C 3/087* (2013.01); *F23D 2203/101* (2013.01)

(58) Field of Classification Search
CPC ..... F23D 2203/101; F23D 14/10; F24C 3/087
USPC ..... 431/354
See application file for complete search history.

(56) References Cited

U.S. PATENT DOCUMENTS

| | | | | |
|---|---|---|---|---|
| 5,899,681 | A * | 5/1999 | Maughan | F23D 14/26 431/286 |
| 6,082,994 | A * | 7/2000 | Grandveau | F23D 14/06 431/354 |
| 9,557,054 | B2 * | 1/2017 | Amati | F23D 14/58 |
| 2011/0265781 | A1 | 11/2011 | Kim et al. | |
| 2012/0052456 | A1 * | 3/2012 | Lin | F23D 14/62 431/354 |
| 2017/0268788 | A1 * | 9/2017 | Culatti | F24C 3/087 |
| 2018/0100655 | A1 * | 4/2018 | Aguilar | F23D 14/08 |
| 2018/0306448 | A1 * | 10/2018 | Cadima | F23D 14/58 |
| 2019/0145626 | A1 * | 5/2019 | Cadima | F23D 14/065 126/39 E |

* cited by examiner

*Primary Examiner* — Ko-Wei Lin
(74) *Attorney, Agent, or Firm* — Chrisman Gallo Tochtrop LLC

(57) ABSTRACT

A gas cavity burner, wherein the present invention discloses a burner applied to ovens, more specifically, the present invention discloses a tubular burner composed by two half-shells disposed superposed conforming an inner mixture and diffusion chamber the receives a comburent and a combustible in order to generate a pilot and primary flames, said two half-shells comprising substantially symmetrical perimetral surfaces wherein one said shell comprises a corrugated perimeter surface while the other comprises a flat perimeter surface, the burner of the present invention also presenting a spacer between both half-shells, in that said spacer reduces deformation issues caused by the heating, while it also brings more control to the pilot flame and aggregates a reduction of material thickness in the manufacturing of the burner.

7 Claims, 2 Drawing Sheets

GAS CAVITY BURNER

BACKGROUND OF THE INVENTION

1. Field of the Invention

The present invention relates to a gas cavity burner applied to ovens, more specifically, the present invention relates to gas cavity burners formed by tubular burners composed by two half-shells disposed one top of another conforming an inner mixture and diffusion chamber, said two half-shells comprising substantially symmetrical perimetral surfaces wherein one said shell comprises a corrugated perimeter surface while the other comprises a flat perimeter surface.

2. Description of Prior Art

Tubular burners are known in the art and are commonly applied to ovens or grills. Typically, said burners are formed by a main chamber which receives a gas or combustible for diffusion, allowing the ignition of pilot and primary flames of the burner.

Primary and pilot flames are main parameters that affect the flame aspects, the combustion emission and the thermal efficiency of the burner and that way, the design of these parameters is a key point for gas burners' project.

One example of burner is disclosed from the application number US2012052456A1 which presents a burner of a gas device that includes a first plate, a second plate engaged with the first plate, and a chamber formed by the first and second plates. The chamber includes first and second distal ends disposed at two opposite ends, and first and second lateral sides disposed at two opposite sides. The chamber further includes a gas inlet hole and an air inlet hole, which are disposed at the first distal end. Furthermore, the chamber includes a first channel connecting with the gas inlet hole and the air inlet hole and includes a first compartment connecting with the first channel. Moreover, the chamber includes a first plurality of flame exit pores and a second plurality of flame exit pores disposed at the first and second lateral sides respectively. The first and second plurality of flame exit pores connect with the first compartment.

Another document regarding a tubular burner is the prior art US2011265781A1 which presents a cooker which includes a cavity including a cooking chamber; and a burner disposed in the cavity, receiving a mixed gas of a gas and air, and generating a flame by burning the mixed gas, in which the burner includes a supplier supplying the gas and the air and at least one combustor receiving the gas and the air from the supplier and including a plurality of flame holes generating the flame, and the combustor includes a gap capable of shifting the flame by communicating between the plurality of flame holes.

Finally, a last tubular burner is known from the document U.S. Pat. No. 9,557,054B2 which reveals a burner for an oven or grill that may include a flat and elongated body extending in a major longitudinal direction and confining an inner chamber configured to receive a comburent and combustible mixture. The body may include two half-shells mutually superposed and coupled in mirror-image relationship and including edge portions defining a coupling plane. A first series of flame holes may define a first flaming front and a second series of flame holes may define a second flaming front, at the coupling plane, on opposite sides of the inner chamber. The body may include a connecting portion between the first and second flaming fronts at an end of the inner chamber. The connecting portion may be defined by connecting walls of the half-shells extending parallel to the coupling plane in a sequence of depressions and elevations between the first and second flaming fronts and configured to transfer flame.

The tubular or cavity burners disclosed in the prior art are restricted in its application and assembly due to their dimension, being susceptible to deformation during manufacturing assembly process. In addition, the usage of the burner may cause structural deformation due to heating, since those burners don't present spacers in its design and, for the same reason, those burners produce a lower stability of the gas quantity delivered to the pilot flame.

SUMMARY OF THE INVENTION

To overcome the above-mentioned disadvantages of the prior art, the present invention discloses a gas cavity burner comprised mainly by two portions, being a first portion formed by a first half-shell having a flat perimeter surface and a second portion formed by a second half-shell having a corrugated perimeter surface, wherein both half-shells are substantially symmetrical and simple in geometry permitting the assembly in several different manner.

The cavity burner of the present invention also presents a spacer allocated between both half-shells, which defines a distance or gap creating a communication from inside to outside of the mixture and diffusion chamber and improving the flame stabilization.

The spacer brings the advantages of reducing the deformation issues caused by the heating, while it also brings more control to the pilot flame, since it controls the quantity of gas delivered to said pilot flame, producing then a more stable pilot flame.

Moreover, the spacer design aggregates the benefit of the reduction of material thickness usage in the manufacturing of the burner, enhancing the material optimization and transportation efficiency and cost, also improving the sustainability of the process and the components.

BRIEF DESCRIPTION OF THE DRAWINGS

Further features and advantages of the present invention are more apparent to those skilled in the art in the detailed description below, with reference to the accompanying drawings.

DETAILED DESCRIPTION OF THE INVENTION

The present invention relates to a gas cavity burner composed by an elongated body comprising two half-shells superposed which conform an inner mixture and diffusion chamber which receives at least a comburent and a combustible gas, said two half-shells formed substantially by symmetrical shapes and defining a merged design improving the pilot and primary flames of the burner.

Figure 1:
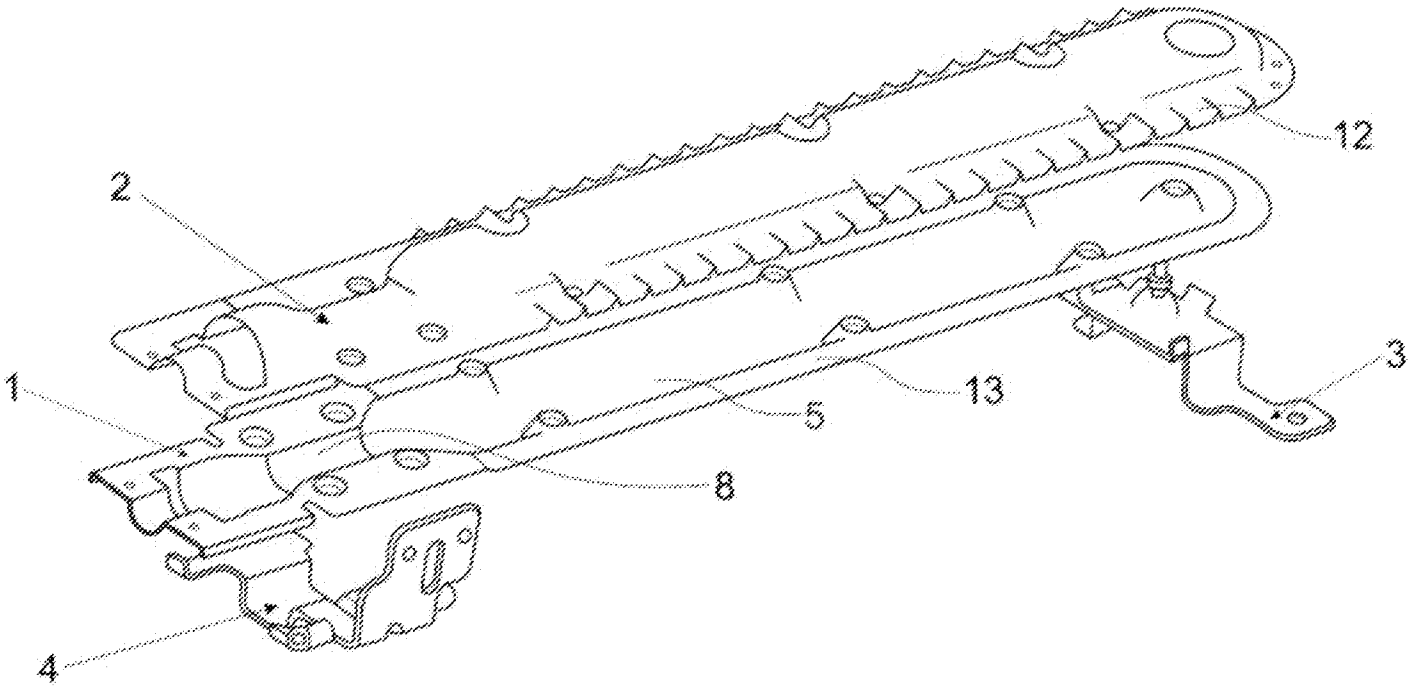
FIG. 1 is a perspective view of the gas cavity burner of the present invention showing said burner in an open view, with both half-shells being apparent.

As can be seen in FIG. 1, the first half-shell 1 comprises an elongated piece having a flat perimeter surface 13 substantially linear over all the longitudinal direction of the burner, as the second half-shell 2 comprises an elongated piece having a corrugated perimeter surface 12 over both sides of said second half-shell 2 and corresponding at least to the length of the flat perimeter surface 13 of the first half-shell 1. Both perimeter surfaces 12 and 13 are substantially parallel to each other when both half-shells 1 and 2 are coupled together.

Said corrugated perimeter surface 12 is formed by a series of "waves", that is, by a series of projections 10 disposed over the length of the perimeter of the second half-shell 2. Also, the projections 10 extend substantially over all the length of the inner mixture and diffusion chamber 5. The coupling between both half-shells 1 and 2 creates said inner mixture and diffusion chamber 5, merging them in only one chamber following the venturi 8, providing with the chamber 5 the gases to the pilot and primary flame ignition.

Every projection 10 defining the corrugated perimeter surface 12 defines the primary flame port 7 which communicates the primary flame from the internal of the mixture and diffusion chamber 5 to the external of the mixture and diffusion chamber 5. The pilot flame port 6 is created by the corrugated perimeter surface 12 reducing the communication from the internal of the mixture and diffusion chamber 5 to the external of said chamber 5.

Figure 2:
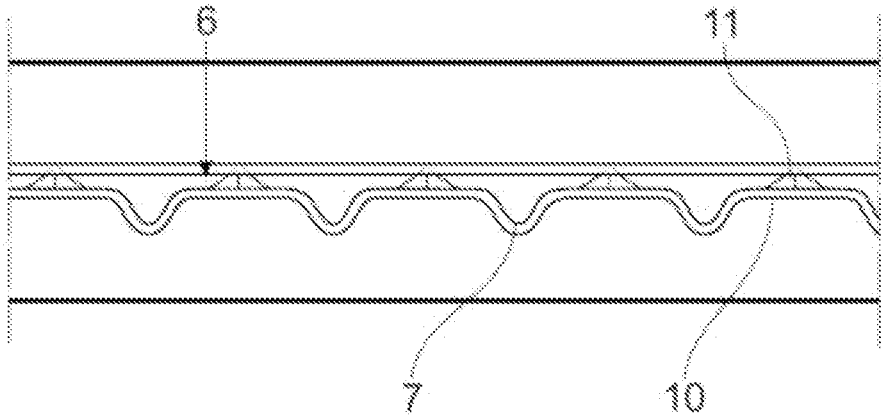
FIG. 2 is an enlarged side view of the burner of the present invention illustrating the corrugated surface and the projections conforming the spacer of the burner.

According to the illustration of FIG. 2, the combination of the corrugated perimeter surface 12 of the second half-shell 2 with the flat perimeter surface 13 of the first half-shell 1 create the primary flame port 7 and the pilot flame port 6, that is, said ports are defined by the distance of the combination of said corrugated and flat perimeter surfaces. In order to have a better performing flame, the primary flame port 7 and the pilot flame port 6 have to be as close as possible.

That way, every projection 10 of the corrugated perimeter surface 12 contains at least a single protrusion on the projection 10 surface, which define a spacer 11 creating a gap between the flat perimeter surface 13 and the corrugated perimeter surface 12 for the creation of the pilot flame port 6.

Said pilot flame is defined then by said spacer 11 and by the coupling of the two perimeter surfaces 12 and 13. Said spacer 11 brings the benefit of reducing the deformation issues caused by heating as it strengthens the corrugated perimeter, improving the heat distribution, the flame stabilization and the cooking as a result.

The spacer 11 of the burner can present different forms and dimensions, as long as it creates a gap with a minimum distance keeping the flat perimeter surface 13 apart from the corrugated perimeter surface 12, that is, apart from the projections 10.

With the coupling of both half-shells 1 and 2 and with the consequent coupling of the flat perimeter surface 13 to the corrugated perimeter surface 12, a series of cavities are created, which provide the primary flame port 7, allowing the communication between inside and outside the mixture and diffusion chamber 5, allowing that way the ignition and spread of said primary flame. Each primary flame port 7 defines a depression of the corrugated perimeter surface 12 and each primary flame port 7 is disposed between two projections 10.

According to the design of the burner of the present invention, the pilot flame can be on top of the primary flame, as well as it can be below the primary flame, since the corrugated perimeter surface 12 can be disposed to the top or to the bottom of the burner, disposing each half-shell 1 and 2 upside or underside. That way, the corrugated design of the present invention permits the application of the burner in different orientations, allowing the burner to be used for bake and also for broil function.

Figure 3:
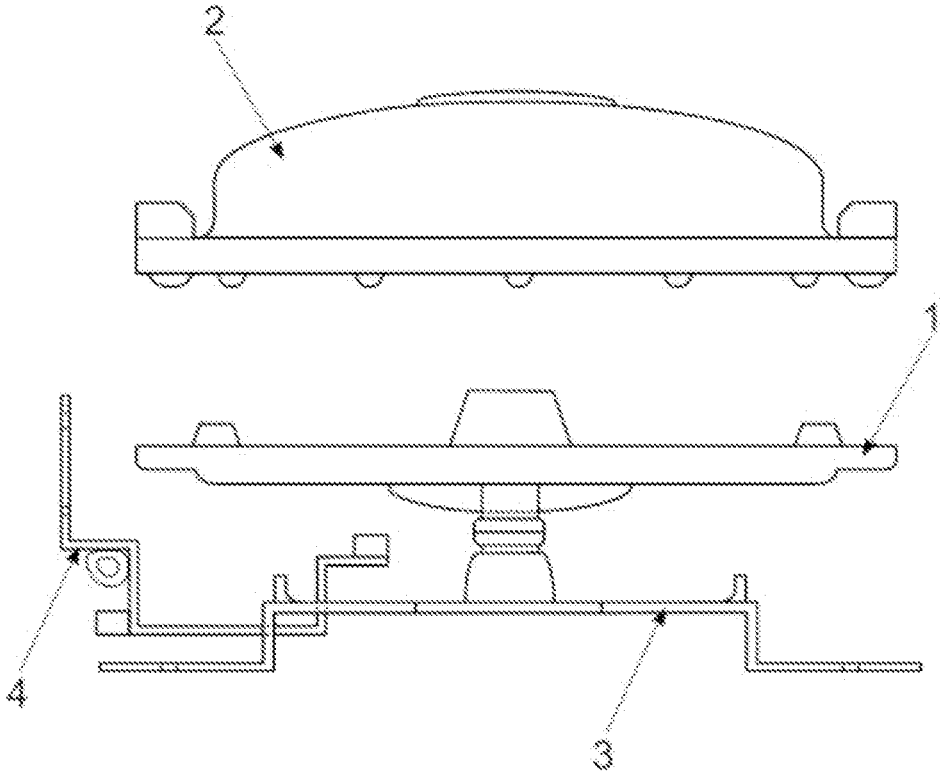
FIG. 3 is a frontal view of the burner illustrating the inner mixture and diffusion chamber and the frontal and rear brackets.

The burner of the present invention also presents a frontal bracket 3 and a rear bracket 4 as illustrated in FIG. 3, wherein said brackets 3 and 4 can be used for fixation and for holding ignition and safety accessories. Since both half-shells 1 and 2 of the burner have a simple external geometry with their bodies being essentially flat on both sides, both brackets 3 and 4 can be disposed in any of the two said half-shells, allowing several possibilities of installation.

Moreover, in another embodiment, the brackets 3 and 4 can be detached, allowing the burner of the present invention to be installed with only one bracket or yet without both brackets.

The invention claimed is:

1. A gas cavity burner, comprising:

an elongated body comprising two half-shells superposed with each other and conforming an inner mixture and diffusion chamber that receives a combustible and comburent gas, wherein both half-shells are formed substantially by symmetrical shapes and the first half-shell comprises a flat perimeter surface and the second half-shell comprises a corrugated perimeter surface, wherein said flat perimeter surface is substantially linear over all the longitudinal direction of the burner, and the corrugated perimeter surface of the second half-shell corresponds to at least a length of said flat perimeter surface of the first half-shell, wherein said corrugated perimeter surface comprises projections disposed over a length of the perimeter of the second half-shell, said projections extending substantially over all a length of the inner mixture and diffusion chamber, wherein every single projection contains at least a single protrusion on each projection surface which defines a spacer creating a respective gap between the flat perimeter surface and the corrugated perimeter surface, said respective gaps defining respective pilot flame ports, wherein coupling of both half-shells with consequent coupling of the flat perimeter surface to the corrugated perimeter surface defines the respective gaps for the respective pilot flame ports and cavities for respective primary flame ports.

2. The gas cavity burner of claim 1, wherein each primary flame port is disposed between two projections of the corrugated perimeter surface.

3. The gas cavity burner of claim 1, wherein both the flat perimeter surface and the corrugated perimeter surface are substantially parallel to each other when both first and second half-shells are coupled together.

4. The gas cavity burner of claim 1, wherein each said spacer comprises a minimum distance to keep the flat perimeter surface apart from the projections of the corrugated perimeter surface.

5. The gas cavity burner of claim 1, further comprising at least one fixation bracket disposed in any of the two half-shells.

6. The gas cavity burner of claim 1, wherein an orientation of the first half shell and the second half-shell is reversible so that the corrugated perimeter surface can be disposed to the top or to the bottom of the burner, thereby permitting the pilot flame to be on top of the primary flame or below the primary flame.

7. The gas cavity burner of claim 1 further comprising: at least one fixation bracket disposed on the elongated body.

* * * * *